US008383974B2

(12) United States Patent
Wada et al.

(10) Patent No.: US 8,383,974 B2
(45) Date of Patent: Feb. 26, 2013

(54) SWITCH DEVICE

(75) Inventors: Kotaro Wada, Kasugai (JP); Shinichi Togawa, Kasugai (JP); Muneki Nishii, Toyota (JP)

(73) Assignee: OMRON Corporation, Kyoto (JP)

( * ) Notice: Subject to any disclaimer, the term of this patent is extended or adjusted under 35 U.S.C. 154(b) by 433 days.

(21) Appl. No.: 12/709,403

(22) Filed: Feb. 19, 2010

(65) Prior Publication Data

US 2010/0219055 A1 Sep. 2, 2010

(30) Foreign Application Priority Data

Feb. 27, 2009 (JP) ..... 2009-045323

(51) Int. Cl.
*H01H 13/00* (2006.01)

(52) U.S. Cl. ..... 200/339

(58) Field of Classification Search ..... 200/339, 200/336, 553, 5 R, 5 B, 5 E
See application file for complete search history.

(56) References Cited

U.S. PATENT DOCUMENTS

2009/0057120 A1 * 3/2009 Kakuno et al. ..... 200/339

FOREIGN PATENT DOCUMENTS

| | | |
|---|---|---|
| JP | 02-087339 | 7/1990 |
| JP | 05-036721 | 5/1993 |

* cited by examiner

*Primary Examiner* — Felix O Figueroa
(74) *Attorney, Agent, or Firm* — Osha Liang LLP

(57) ABSTRACT

A switch device has a casing, a tubular portion provided on the casing, an upper surface and a lower surface of the tubular portion being opened, a support shaft provided in the tubular portion, a manipulation knob attached to the tubular portion such that an opening in the upper surface is covered therewith, the manipulation knob being turned about the support shaft by manipulation, a first hitting portion provided in the manipulation knob, a first hit portion provided in the tubular portion, the first hitting portion hitting the first hit portion when the manipulation knob is turned to reach a limit of an operating range of a turning operation of the manipulation knob, and a second hitting portion provided in the manipulation knob independently of the first hitting portion.

9 Claims, 13 Drawing Sheets

SWITCH DEVICE

BACKGROUND OF THE INVENTION

1. Technical Field

The present invention relates to a switch device that switches ON and OFF states by manipulating a manipulation knob.

2. Related Art

In a switch device in which ON and OFF states are switched by manipulating a manipulation knob, constituent members of the switch device occasionally hit each other to generate a sound in manipulating the manipulation knob. A user feels discomfort to the hitting sound, and the hitting sound becomes a noise.

In order to reduce the hitting sound during the manipulation, in a switch device disclosed in Japanese Unexamined Utility Model Publication No. 5-36721, a buffer member is interposed between an inner bottom surface of a cylindrical projection and a lower end-face of a sliding member, which hit each other in manipulating the manipulation knob. In a switch device disclosed in Japanese Unexamined Utility Model Publication No. 2-87339, a soft portion made of thermoplastic resin such as an elastomer having low surface hardness is provided by co-molding in one of an external surface of a manipulation handle (corresponding to the manipulation knob) and an abutment portion that is of an inner surface of a hole in a cover, which hit each other during the manipulation of the manipulation handle, or a soft portion that relaxes an impact with a terminal plate or a plate spring that avoids the hitting between the manipulation handle and the abutment portion is provided in a lower-end portion of the manipulation handle.

SUMMARY

As described above, in the conventional switch device disclosed in Japanese Unexamined Utility Model Publication Nos. 5-36721 and 2-87339, a hitting point between components that hit each other in manipulating the manipulation knob concentrates on one point, and a buffer member is provided in the hitting point. One or more embodiments of the present invention disperses the hitting point to reduce the hitting sound in manipulating the switch device.

In accordance with one aspect of the present invention, there is provided a switch device including: a casing; a tubular portion that is provided on the casing, an upper surface and a lower surface of the tubular portion being opened; a support shaft that is provided in the tubular portion; a manipulation knob that is attached to the tubular portion such that an opening in the upper surface is covered therewith, the manipulation knob being turned about the support shaft by manipulation; a first hitting portion that is provided in the manipulation knob; a first hit portion that is provided in the tubular portion, the first hitting portion hitting the first hit portion when the manipulation knob is turned to reach a limit of an operating range of the turning operation of the manipulation knob; a second hitting portion that is provided in the manipulation knob independently of the first hitting portion; a second hit portion that is provided in the casing so as to be separated from the tubular portion, the second hitting portion hitting the second hit portion when the manipulation knob is turned to reach the limit of the operating range of the turning operation of the manipulation knob, wherein ON and OFF states are switched based on the turning operation of the manipulation knob, the second hitting portion and the second hit portion are provided at positions at which the second hitting portion hits the second hit portion before the first hitting portion hits the first hit portion during the turning operation of the manipulation knob, and at least one of the second hitting portion and the second hit portion bends when the second hitting portion hits the second hit portion.

Accordingly, the hitting impact generated between the manipulation knob and the tubular portion in manipulating the manipulation knob does not concentrate on one point, but the hitting impact is absorbed while being dispersed into the first and second hitting portions and hit portions, so that the generated hitting sound can be reduced. Since the second hit portion is provided so as to be separated from the tubular portion, a deformation amount of each surface of the tubular portion decreases when the first and second hitting portions hit the first and second hit portions by the manipulation of the manipulation knob. Therefore, the resounding hitting sound caused by the deformation can be reduced. Since the first hitting portion hits the first hit portion after the second hitting portion hits the second hit portion, the timings in which the hitting sounds are generated are temporally shifted from each other, and therefore the hitting sound can be reduced. Moreover, at least one of the second hitting portion and the second hit portion bends to relax the hitting impact, so that the hitting sound can be reduced.

In the above switch device, an area where the second hitting portion hits the second hit portion may be smaller than an area where the first hitting portion hits the first hit portion. In this manner, the hitting sound between the second hitting portion and the second hit portion is reduced smaller than the hitting sound between the first hitting portion and the first hit portion during the swing manipulation of the manipulation knob, and the hitting sound can be reduced as a whole.

In the above switch device, the second hitting portion may be provided in a lower-end portion of the manipulation knob, and the second hit portion may be formed in a side portion of the tubular portion so as to be projected upward.

The switch device may further include: a switch that is provided in the casing; a manipulation rod that transmits the turning operation of the manipulation knob to switch the ON and OFF states of the switch; and an elastic material that generates an elastic force for returning the turned manipulation knob to a predetermined stationary position. In this case, the switch includes an electric contact that performs an switching operation.

In accordance with another aspect of the present invention, there is provided a switch device including: a casing; a tubular portion that is provided on the casing, an upper surface and a lower surface of the tubular portion being opened; a support shaft that is provided in the tubular portion; a manipulation knob that is attached to the tubular portion such that an opening in the upper surface is covered therewith, the manipulation knob being turned about the support shaft by manipulation; a first hitting portion that is provided in the manipulation knob; a first hit portion that is provided in the tubular portion, the first hitting portion hitting the first hit portion when the manipulation knob is turned to reach a limit of an operating range of the turning operation of the manipulation knob; a second hitting portion that is provided in the manipulation knob independently of the first hitting portion; a second hit portion that is provided in a surface identical to a surface in which the first hit portion of the tubular portion is provided, the second hitting portion hitting the second hit portion when the manipulation knob is turned to reach the limit of the operating range of the turning operation of the manipulation knob, wherein ON and OFF states are switched based on the turning operation of the manipulation knob, a notch is formed near the second hit portion in the surface identical to the surface in which the first hit portion is provided, the second hitting portion and the second hit portion are provided at positions at which the second hitting portion hits the second hit portion before the first hitting portion hits the first hit portion during the turning operation of the manipulation knob, and at least one of the second hitting portion and the second hit portion bends when the second hitting portion hits the second hit portion.

Accordingly, the hitting impact generated between the manipulation knob and the tubular portion in manipulating the manipulation knob does not concentrate on one point, but the hitting impact is absorbed while being dispersed into the first and second hitting portions and hit portions, so that the generated hitting sound can be reduced. Since the first hitting portion hits the first hit portion after the second hitting portion hits the second hit portion, the timings in which the hitting sounds are generated are temporally shifted from each other, and therefore the hitting sound can be reduced. Moreover, at least one of the second hitting portion and the second hit portion bends to relax the hitting impact, so that the hitting sound can be reduced.

According to one or more embodiments of the present invention, the hitting point between the manipulation knob and the tubular portion can be dispersed to reduce the hitting sound generated in manipulating the manipulation knob.

DETAILED DESCRIPTION

Figure 1:
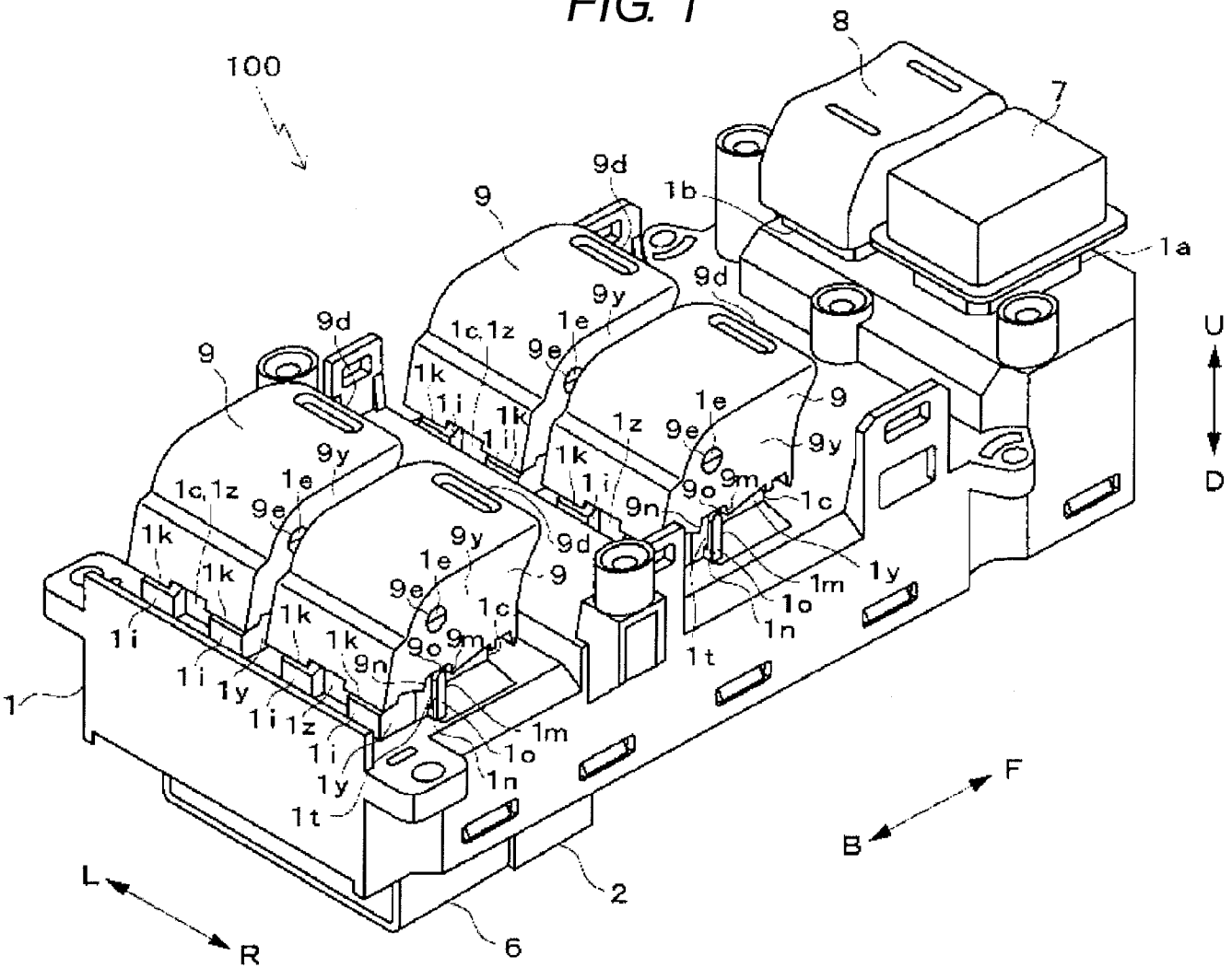
FIG. 1 is a perspective view illustrating a switch device according to an embodiment of the present invention.
Figure 2:
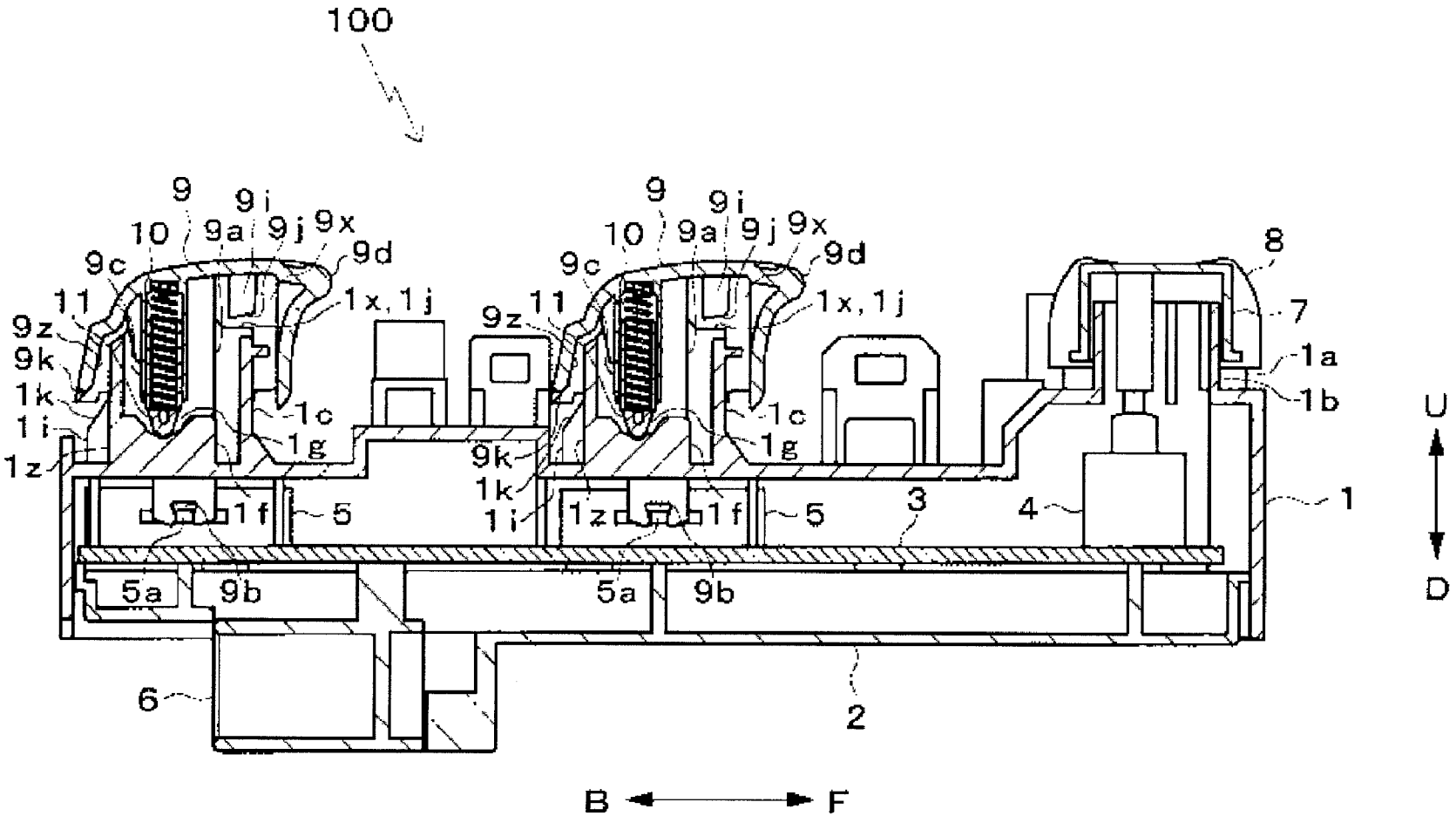
FIG. 2 is a sectional view of the switch device.

In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. FIG. 1 is a perspective view illustrating a switch device 100 according to an embodiment of the present invention. FIG. 2 is a sectional view of the switch device 100. The switch device 100 is used in a power window device, and the switch device 100 is mounted on an armrest (not illustrated) provided in a door of a vehicle driver seat. As illustrated in FIG. 2, a lower side (D-direction side) of a casing 1 of the switch device 100 is opened, and the lower side is closed by fitting a cover 2 therein. Electronic components such as a circuit board 3 and electric switches 4 and 5 are stored in the casing 1. The circuit board 3 is supported while sandwiched between the casing 1 and the cover 2. Electronic components such as the electric switches 4 and 5 and a connector 6 are mounted on the circuit board 3 to form an electric circuit. The connector 6 is projected from the cover 2. A cable connected to a control device (not illustrated) is fitted in the connector 6, which allows output signals of the electric switches 4, 5 and the like to be transmitted from the switch device 100 to the control device.

Figure 3:
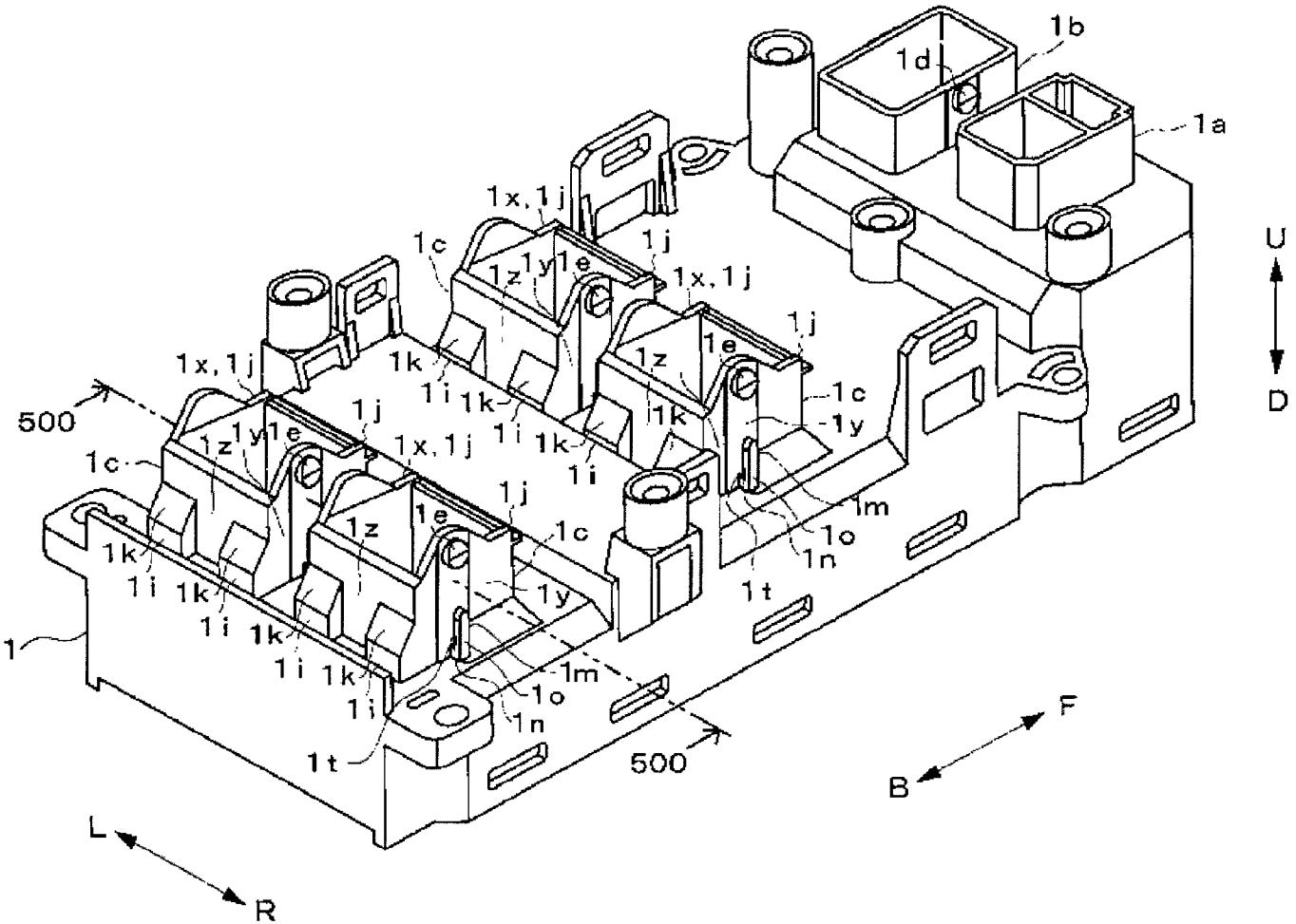
FIG. 3 is a perspective view of a casing of the switch device.

FIG. 3 is a perspective view of the casing 1. Each of tubular portions 1*a* to 1*c* having a rectangular shape is integrally provided on the casing 1. In the tubular portions 1*a* to 1*c*, an upper surface (end face on the U-direction side) and a lower surface (end face on the D-direction side) are opened and communicated with the inside of the casing 1. A manipulation knob 7 illustrated in FIGS. 1 and 2 is attached to the tubular portion 1*a* such that the opening in the upper surface of the tubular portion 1*a* is covered therewith. The manipulation knob 7 engages the push-lock type electric switch 4 as illustrated in FIG. 2 while attached to the tubular portion 1*a*. An electric contact (not illustrated) provided in the electric switch 4 is switched between the ON state (closed; conduction) and the OFF state (opened; non-conduction) by pressing down the manipulation knob 7, whereby all the windows of the vehicle are locked so as not to be able to be opened and closed or all the windows are unlocked.

As illustrated in FIG. 3, support shafts 1*d* are integrally provided in side faces on the right-and-left direction R and L (traverse direction of the casing 1) of the tubular portion 1*b*, respectively (the support shaft 1*d* in the L-direction side is not illustrated). A manipulation knob 8 illustrated in FIGS. 1 and 2 is attached to the tubular portion 1*b* such that the opening in the upper surface of the tubular portion 1*b* is covered therewith. The manipulation knob 8 engages an electric switch (not illustrated) mounted on the circuit board 3 while attached to the tubular portion 1*b*. The manipulation knob 8 is turned about a support shaft 1*d* by swinging the manipulation knob 8 in a front-back direction F and B (longitudinal direction of casing 1). The turning operation of the manipulation knob 8 switches the electric contact (not illustrated) provided in the electric switch between the ON state and the OFF state, whereby all the windows of the vehicle are locked so as not to be able to be opened and closed or all the windows are unlocked.

Figure 5:
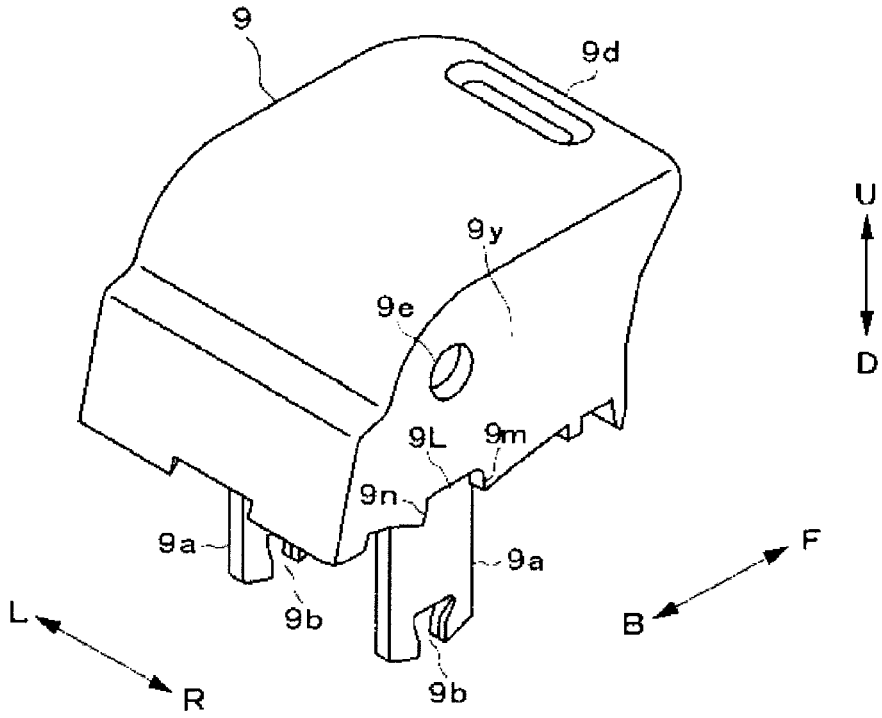
FIG. 5 is a perspective view of a manipulation knob of the switch device.
Figure 6A:
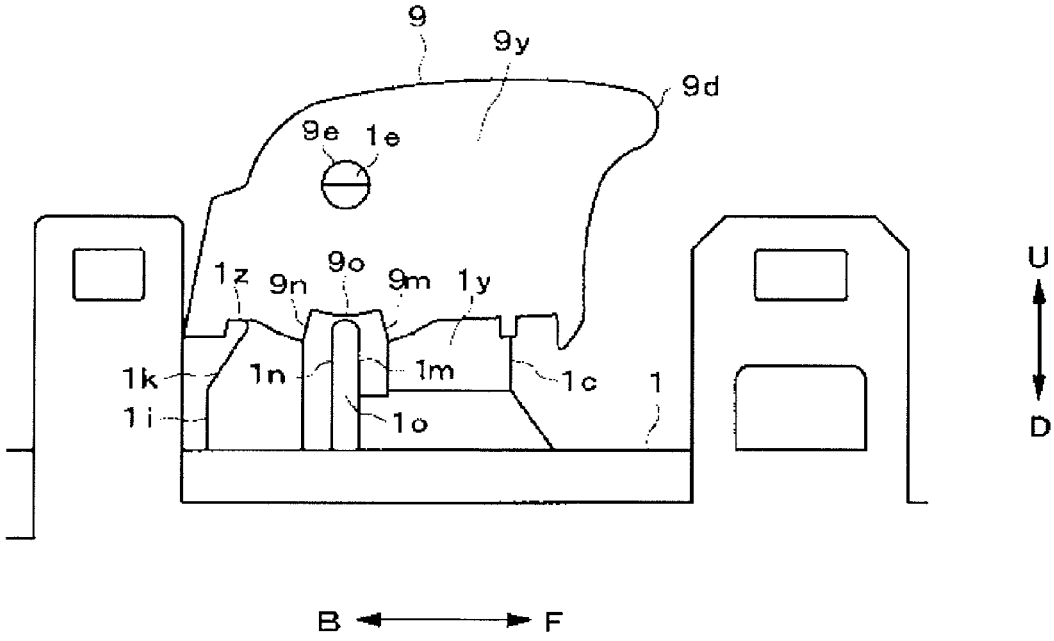
FIG. 6A is an enlarged side view illustrating a neighborhood of the manipulation knob of the switch device.
Figure 6B:
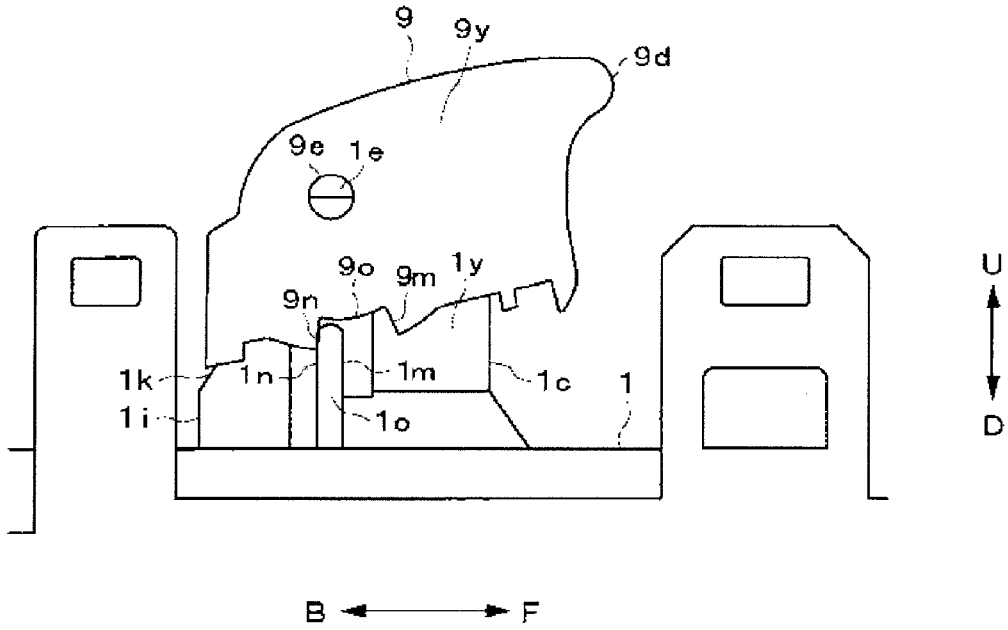
FIG. 6B is an enlarged side view illustrating a neighborhood of the manipulation knob of the switch device.
Figure 6C:
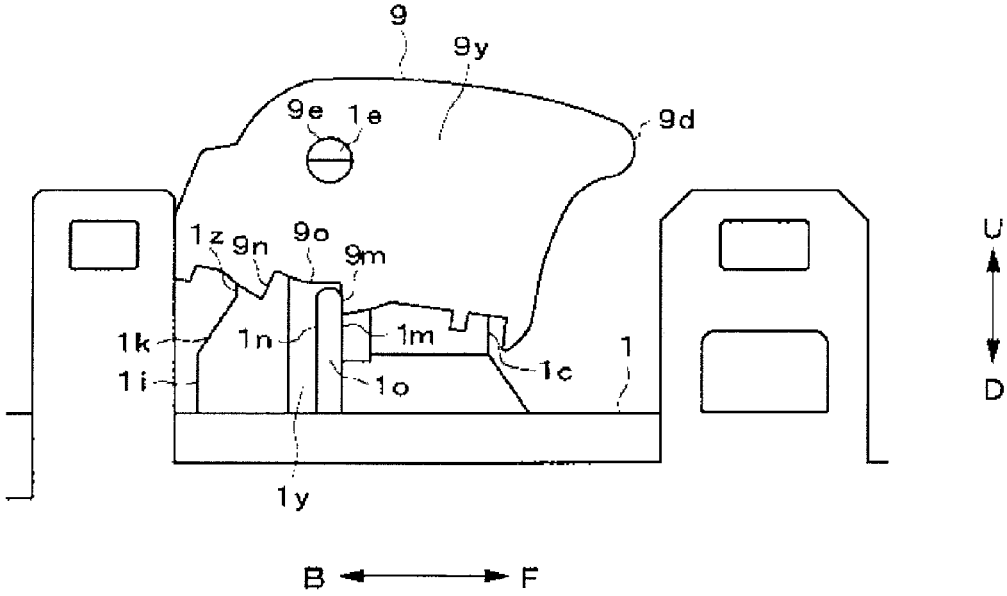
FIG. 6C is an enlarged side view illustrating a neighborhood of the manipulation knob of the switch device.
Figure 7A:
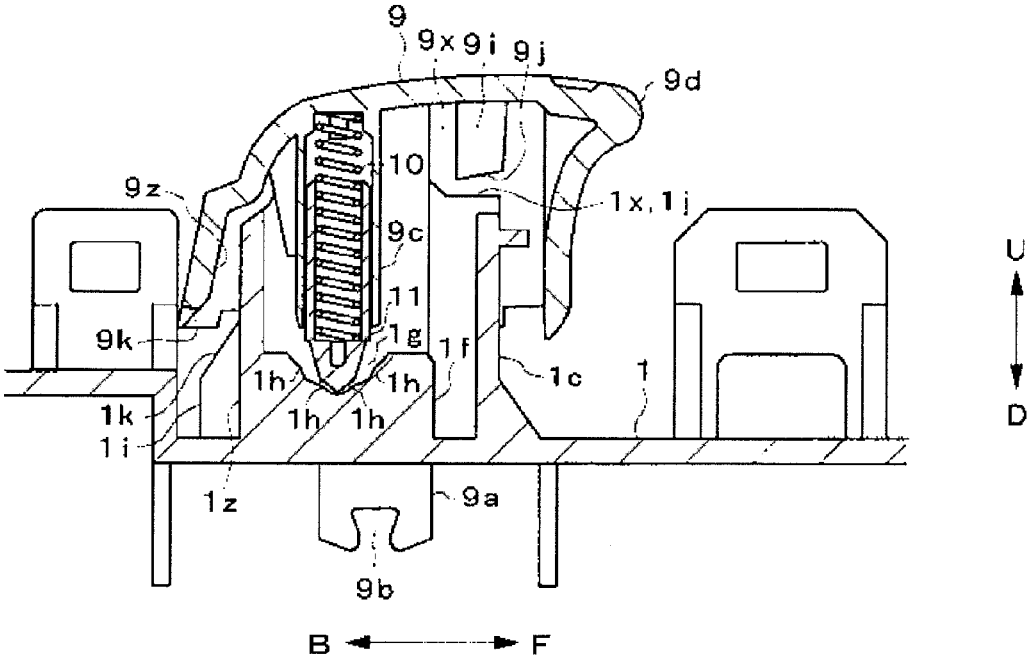
FIG. 7A is an enlarged sectional view illustrating a neighborhood of the manipulation knob of the switch device.
Figure 7B:
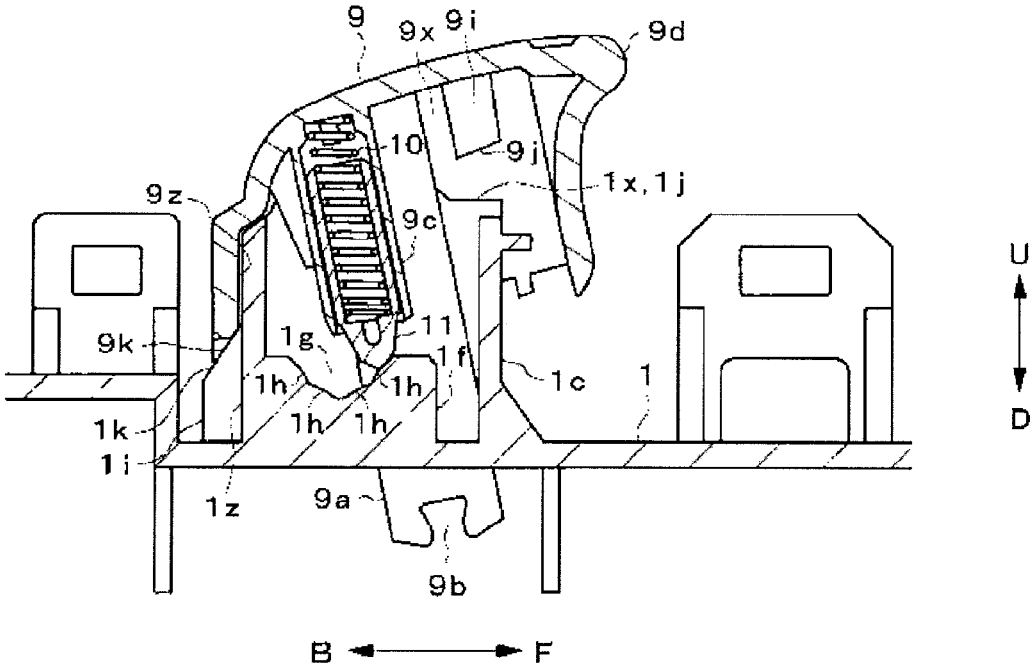
FIG. 7B is an enlarged sectional view illustrating a neighborhood of the manipulation knob of the switch device.
Figure 7C:
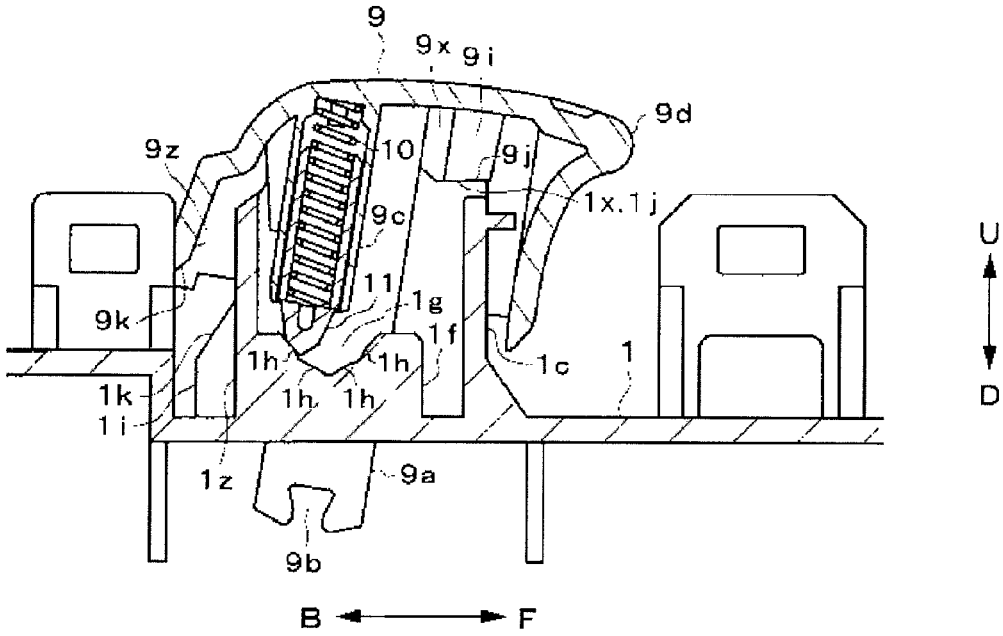
FIG. 7C is an enlarged sectional view illustrating a neighborhood of the manipulation knob of the switch device.

As illustrated in FIG. 3, four tubular portions 1*c* are provided on the casing 1. A manipulation knob 9 illustrated in FIGS. 1 and 2 is attached to each tubular portion 1*c* such that an opening in an upper surface 1*x* of each tubular portion 1*c* is covered therewith. FIG. 5 is a perspective view of the manipulation knob 9. FIGS. 6A to 6C are enlarged side views illustrating a neighborhood of the manipulation knob 9 of the switch device 100. FIGS. 7A to 7C are enlarged sectional views illustrating a neighborhood of the manipulation knob 9 of the switch device 100. Each of the casing 1, the cover 2, and the manipulation knobs 7 to 9 is made of a synthetic resin material and is formed by general injection molding.

As illustrated in FIGS. 1, 5, and 6A to 6C, holes 9*e* are provided in external surfaces (sidewalls) 9*y* in the right-and-left direction R and L of the manipulation knob 9, respectively (the external surface 9*y* and hole 9*e* on the L-direction side are not illustrated). As illustrated in FIGS. 1, 3, and 6A to 6C, support shafts 1*e* are integrally provided in external surfaces 1*y* in the right-and-left direction R and L of the tubular portion 1*c*, respectively (the external surface 1*y* and support shaft 1*e* on the L-direction side are not illustrated). The tubular portion 1*c* is covered from above (U-direction side) with the manipulation knob 9, and each support shaft 1*e* of the tubular portion 1*c* is fitted in each hole 9*e* of the manipulation knob 9, thereby attaching the manipulation knob 9 to the tubular portion 1*c*. A front-end portion 9*d* of the manipulation knob 9 is pushed down or pulled up while the manipulation knob 9 is attached to the tubular portion 1*c*, and the manipulation knob 9 is swung in the front-back direction F and B as illustrated in FIGS. 6A to 7C, thereby turning the manipulation knob 9 about the support shaft 1*e*.

As illustrated in FIGS. 2, 5, and 7A to 7C, a manipulation rod 9*a* and a tubular portion 9*c* are integrally provided inside the manipulation knob 9. The manipulation rod 9*a* is projected downward from a main body of the manipulation knob 9. A recess 9*b* is provided in a lower-end portion of the manipulation rod 9*a*. While the manipulation knob 9 is attached to the tubular portion 1*c*, the manipulation rod 9*a* penetrates through the tubular portion 1*c* to extend into the casing 1 as illustrated in FIGS. 2 and 7A to 7C. As illustrated in FIG. 2, an actuator 5*a* of the slide type electric switch 5 engages the recess 9*b* of the manipulation rod 9*a*. When the manipulation knob 9 is turned, the manipulation rod 9*a* transmits the turning operation of each manipulation knob 9 to the corresponding actuator 5*a* of the electric switch 5 to slide the actuator 5*a* in the front-back direction F and B, and an electric contact (not illustrated) provided in the electric switch 5 is switched between the ON and OFF states to open and close the four windows provided in the vehicle.

The tubular portion 9*c* of the manipulation knob 9 is projected downward, and a lower surface (end face on D-direction side) of the tubular portion 9*c* is opened. A coil spring 10 made of an elastic material and a plunger 11 are inserted in the tubular portion 9*c*. A support base 1*f* is integrally provided in each tubular portion 1*c* of the casing 1 so as not to obstruct the penetration of the manipulation rod 9*a*. A V-shape groove 1*g* is provided in the support base 1*f*. A step 1*h* is provided in an inclined surface inclined in the front-back direction F, B of the groove 1*g*. The plunger 11 is biased downward by an elastic force of a coil spring 10 while the manipulation knob 9 is attached to the tubular portion 1*c*, whereby a leading end of the plunger 11 engages the groove 1*g*.

Before the manipulation knob 9 is swung, the plunger 11 is pressed against the deepest bottom of the groove 1*g* by the elastic force of the coil spring 10 as illustrated in FIG. 7A. Therefore, the manipulation knob 9 rests stably with an attitude illustrated in FIGS. 6A and 7A. When the manipulation knob 9 is swung as illustrated in FIGS. 6B, 6C, 7B, and 7C, the plunger 11 moves along the inclined surface of the groove 1*g* to cross over the step 1*h*, thereby generating a click feeling. When the swing manipulation of the manipulation knob 9 is released, the plunger 11 is pushed back to the deepest bottom of the groove 1*g* by the elastic force of the coil spring 10 as illustrated in FIG. 7A, the turned manipulation knob 9 returns to a stationary position as illustrated in FIGS. 6A and 7A.

As illustrated in FIGS. 7A to 7C, first hitting portions 9*j* and 9*k* are provided in each manipulation knob 9, and first hit portions 1*j* and 1*k* are provided in each tubular portion 1*c*. The first hitting portion 9*j* (9*k*) hits the first hit portion 1*j* (1*k*) when the manipulation knob 9 is turned to reach a limit of an operating range of the turning operation of the manipulation knob 9. That is, the hitting portion 9*j* and the hit portion 1*j* and the hitting portion 9*k* and the hit portion 1*k* act as a stopper that restricts the turning operation of each manipulation knob 9 to a predetermined angle. The hitting portion 9*j* includes an inclined surface at a lower end of the projection 9*i* that is integrally provided in front (F-direction side) of the manipulation rod 9*a* of the internal surface 9*x* in the right-and-left direction R and L of the manipulation knob 9 (the internal surface 9*x*, the projection 9*i*, and the hitting portion 9*j* on the L-direction side are illustrated in FIGS. 7A to 7C, and those on the R-direction side are not illustrated in FIGS. 7A to 7C). The hitting portion 9*k* includes an inclined surface provided in a lower-end portion of an internal surface 9*z* on a back side (B-direction side) of the manipulation knob 9. That is, the first hitting portions 9*j* and 9*k* are part of the manipulation knob 9. The hit portion 1*j* includes a horizontal upper surface (part of the upper surface 1*x* of the tubular portion 1*c*) located in a front portion of the tubular portion 1*c*. The hit portion 1*k* includes an inclined surface at an upper end of the projection 1*i* that is integrally provided in an external surface 1*z* on the back side of the tubular portion 1*c*. That is, the first hit portions 1*j* and 1*k* are part of the tubular portion 1*c*.

As illustrated in FIG. 1, second hitting portions 9*m* and 9*n* are provided in each manipulation knob 9, and second hit portions 1*m* and 1*n* are provided in the casing 1 so as to be separated from each tubular portion 1*c*. As illustrated in FIGS. 6A to 6C, the second hitting portion 9*m* (9*n*) hits the second hit portion 1*m* (1*n*) by the turning operation of the manipulation knob 9. The second hitting portion 9*m* (9*n*) hits the second hit portion 1*m* (1*n*) before the first hitting portion 9*j* (9*k*) hits the first hit portion 1*j* (1*k*). That is, the hitting portion 9*m* (9*n*) and the hit portion 1*m* (1*n*) have a function of releasing an impact when the hitting portion 9*j* (9*k*) hits the hit portion 1*j* (1*k*).

Figure 4:
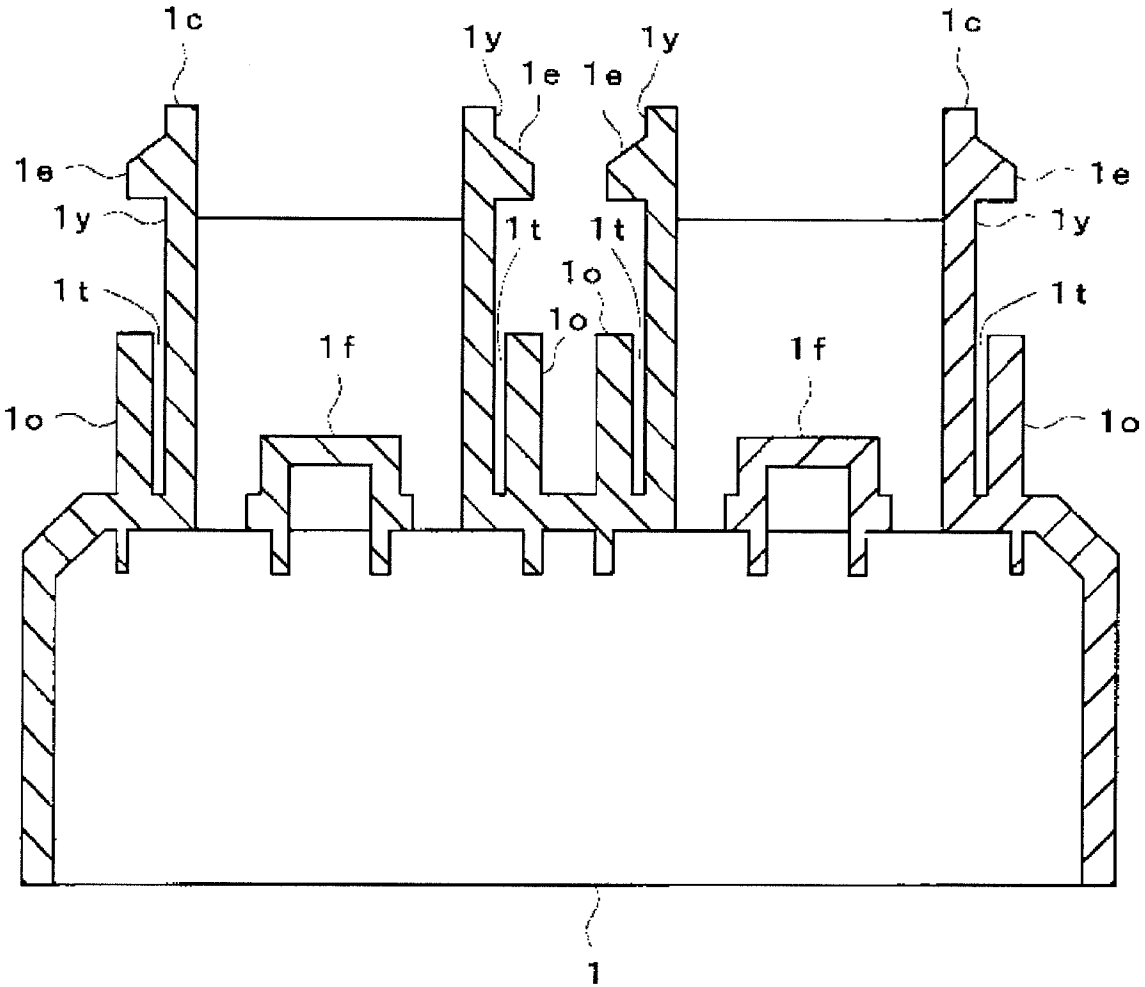
FIG. 4 is a sectional view taken along line 500-500 of FIG. 3.

The second hitting portions 9*m* and 9*n* include a front side-face and a back side-face of a notch 90 that is provided in the lower-end portion of the external surface 9*y* in the right-and-left direction R and L of the manipulation knob 9, respectively (the external surface 9*y*, the notch 9*o*, and the hitting portions 9*m* and 9*n* on the R-direction side are illustrated in FIGS. 6A to 6C, and those on the L-direction side are not illustrated in FIGS. 6A to 6C). That is, the second hitting portions 9*m* and 9*n* are provided in the surface 9*y* that is different from the surfaces 9*x* and 9*z* in which the first hitting portions 9*j* and 9*k* of the manipulation knob 9 are provided, and the second hitting portions 9*m* and 9*n* are part of the manipulation knob 9, which is different from the first hitting portions 9*j* and 9*k*. The second hit portions 1*m* and 1*n* include a front side-face and a back side-face of a projection 1*o* that is integrally provided in a base of the external surface 1*y* in the right-and-left direction R and L of the tubular portion 1*c* so as to be projected outward, respectively (the external surface 1*y*, the projection 1*o*, and the hit portions 1*m* and 1*n* on the R-direction side are illustrated in FIGS. 6A to 6C, and those on the L-direction side are not illustrated in FIGS. 6A to 6C). A notch 1*t* (see FIG. 4) is formed in the projection 1*o*. Therefore, the hit portions 1*m* and 1*n* are formed so as to be separated from the external surface 1*y* and so as to be projected toward an upwardly lateral direction of the external surface 1*y*. That is, the second hit portions 1*m* and 1*n* are provided in the surface 1*y* that is different from the surfaces 1*x* and 1z in which the first hit portions 1j and 1k of the tubular portion 1c are provided, and the second hit portions 1m and 1n are part of the tubular portion 1c, which is different from the first hit portions 1j and 1k. The second hit portions 1m and 1n are formed so as to be projected upward from the surface of the casing 1 while separated from the external surface 1y. Therefore, the second hit portions 1m and 1n have elasticity, and the second hit portions 1m and 1n bend when the second hitting portions 9m and 9n hit the second hit portions 1m and 1n. A hitting (contact) area between the second hitting portions 9m and 9n and the second hit portions 1m and 1n is smaller than a hitting area between the first hitting portions 9j and 9k and the first hit portions 1j and 1k.

When the front-end portion 9d of the manipulation knob 9 is pulled up by a finger to turn the manipulation knob 9, first the second hitting portion 9n of the manipulation knob 9 hits the second hit portion 1n as illustrated in FIG. 6B, and the second hit portion 1n bends slightly toward the frontward direction to relax the hitting impact. Then, as illustrated in FIG. 7B, the first hitting portion 9k of the manipulation knob 9 hits the first hit portion 1k of the tubular portion 1c to stop the turning operation of the manipulation knob 9.

When the front-end portion 9d of the manipulation knob 9 is pushed down by a finger to turn the manipulation knob 9, first the second hitting portion 9m of the manipulation knob 9 hits the second hit portion 1m as illustrated in FIG. 6C, and the second hit portion 1m bends slightly toward the backward direction to relax the hitting impact. Then, as illustrated in FIG. 7C, the first hitting portion 9j of the manipulation knob 9 hits the first hit portion 1j of the tubular portion 1c to stop the turning operation of the manipulation knob 9.

Because the second hitting portions 9m and 9n and the second hit portions 1m and 1n are provided in addition to the first hitting portions 9j and 9k and the first hit portions 1j and 1k, the hitting impact generated between the manipulation knob 9 and the tubular portion 1c during the swing manipulation of the manipulation knob 9 does not concentrate on one point, but the hitting impact can be absorbed while being dispersed into the hitting portions 9j, 9k, 9m, and 9n and the hit portions 1j, 1k, 1m, and 1n. Therefore, the hitting sound generated during the swing manipulation of the manipulation knob 9 can be reduced.

The second hitting portions 9m and 9n and the second hit portions 1m and 1n are provided on the side of the surfaces 9y and 1y that are different from the surfaces 9x, 9z, 1x, and 1z in which the first hitting portions 9j and 9k of the manipulation knob 9 and the first hit portions 1j and 1k of the tubular portion 1c are provided. Therefore, deformation amounts of the surfaces 9x to 9z, 1x to 1z can be reduced when the first and second hitting portions 9j, 9k, 9m, and 9n hit the hit portions 1j, 1k, 1m, and 1n by the swing manipulation of the manipulation knob 9. Accordingly, the influence of the resounding hitting sound caused by the deformations of the surfaces 9x to 9z, 1x to 1z on the manipulation knob 9, the tubular portion 1c, and the casing 1 can be reduced.

During the swing manipulation of the manipulation knob 9, the second hitting portions 9m and 9n hit the second hit portions 1m and 1n before the first hitting portions 9j and 9k hit the first hit portions 1j and 1k, so that the hitting impact between the first hitting portions 9j and 9k and the first hit portions 1j and 1k can be absorbed after the hitting impact between the second hitting portions 9m and 9n and the second hit portions 1m and 1n is absorbed. Therefore, the hitting sound can be further reduced, because the timing of the hitting sound that is generated when the second hitting portions 9m and 9n hit the second hit portions 1m and 1n and the timing of the hitting sound that is generated when the first hitting portions 9j and 9k hit the first hit portions 1j and 1k are temporally shifted from each other.

Since the second hit portions 1m and 1n are separated from the external surface 1y, the deformation of the tubular portion 1c can be suppressed when the second hitting portions 9m and 9n hit the second hit portions 1m and 1n by the swing manipulation of the manipulation knob 9. Therefore, resonance of the casing 1c, which is caused by the deformation of the tubular portion 1c, can be suppressed to reduce the hitting sound between the manipulation knob 9 and the tubular portion 1c.

Since the hitting area between second hitting portions 9m and 9n and the second hit portions 1m and 1n is smaller than that between the first hitting portions 9j and 9k and the first hit portions 1j and 1k, the hitting sound between the second hitting portions 9m and 9n and the second hit portions 1m and 1n is reduced smaller than the hitting sound between the first hitting portions 9j and 9k and the first hit portions 1j and 1k during the swing manipulation of the manipulation knob 9, and the hitting sound can be reduced as a whole.

Since the second hit portions 1m and 1n are separated from the external surface 1y by the formation of the notch 1t, the second hit portions 1m and 1n bend easily. Therefore, when the second hitting portions 9m and 9n hits the second hit portions 1m and 1n by the swing manipulation of the manipulation knob 9, the hit portions 1m and 1n bend to relax the hitting impact, and the generation of the hitting sound can be prevented.

In the switch devices disclosed in Japanese Unexamined Utility Model Publication Nos. 5-36721 and 2-87339, the buffer member is added in order to reduce the hitting sound during the manipulation, and the buffer member is different from the manipulation knob and the member that supports the manipulation knob (for example, a cylindrical projection and a sliding member of Japanese Unexamined Utility Model Publication No. 5-36721, or a cover and a terminal plate of Japanese Unexamined Utility Model Publication No. 2-87339), which results in the cost increase. Particularly, as in Japanese Unexamined Utility Model Publication No. 2-87339, when a soft portion or a plate spring which is made of another material is provided in the manipulation handle or the cover by the co-molding, the production cost increases.

On the other hand, in the present embodiment, there is no need to add another buffer member to the manipulation knob 9 and the casing 1 including the tubular portion 1c that supports the manipulation knob 9. The first and second hitting portions 9j, 9k, 9m, and 9n and the hit portions 1j, 1k, 1m, and 1n are provided in the manipulation knob 9 and the tubular portion 1c, not by the co-molding whose cost is relatively high, but by general injection molding whose cost is relatively low. Therefore, the number of components is maintained, and the increase in the cost of the switch device 100 can be prevented while the hitting sound generated during the swing manipulation of the manipulation knob 9 is reduced.

In the present invention, various modes can be adopted in addition to the embodiment above. For example, in the embodiment above, in the second hitting portions 9m and 9n and the second hit portions 1m and 1n, the hitting portion 9m and 9n include the side surface in the front-back direction F and B of the notch 9o that is provided in the external surface 9y in the right-and-left direction R and L of the manipulation knob 9, and the hit portions 1m and 1n include the side surface in the front-back direction F and B of the projection 1o that is provided in the base of the external surface 1y in the right-and-left direction R and L of the tubular portion 1c so as to be projected outward, the notch 1t is formed in the projection 1o, and only the hit portions 1m and 1n have the elasticity to increase the amount of deformation generated by the hitting. However, the present invention is not limited thereto.

Figure 8:
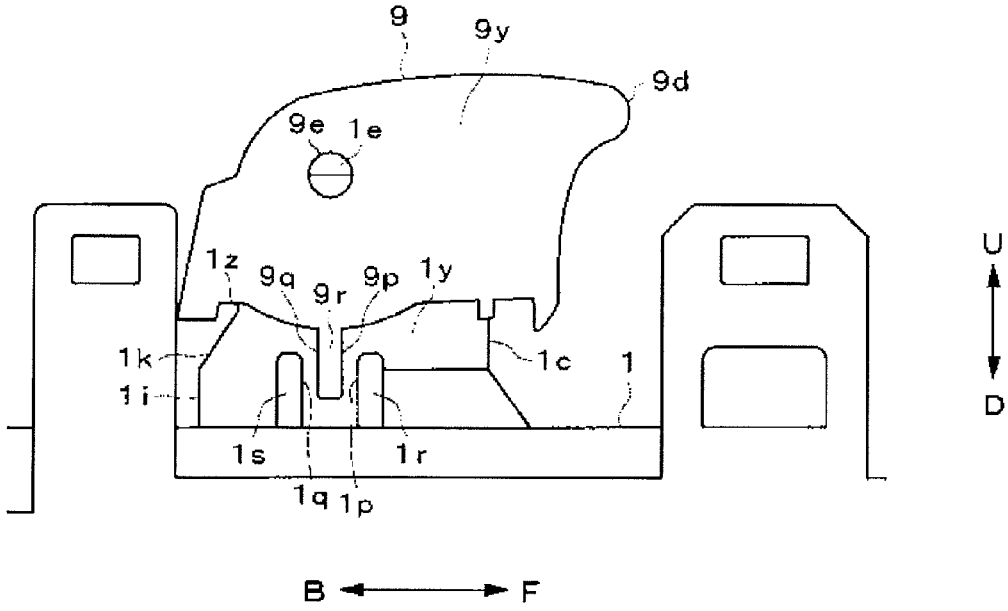
FIG. 8 illustrates a switch device according to another embodiment of the present invention.

Additionally, for example, as illustrated in FIG. 8, the second hitting portion may include side faces 9*p* and 9*q* in the front-back direction F and B of a projection 9*r* that is integrally provided in the lower-end portion of the external surface 9*y* in the horizontal direction (direction perpendicular to the direction F and B and the direction U and D) of the manipulation knob 9 so as to be projected toward the outside of the manipulation knob 9, and the second hit portion may include side faces 1*p* and 1*q* facing projections 1*r* and 1*s* that are projected in the horizontal direction of the tubular portion 1*c* so as to be projected upward. The elasticity may be imparted to at least one of the projection 9*r* on the side of the manipulation knob 9 and the projections 1*r* and 1*s* to increase the amount of deformation generated by the hitting.

Figure 9:
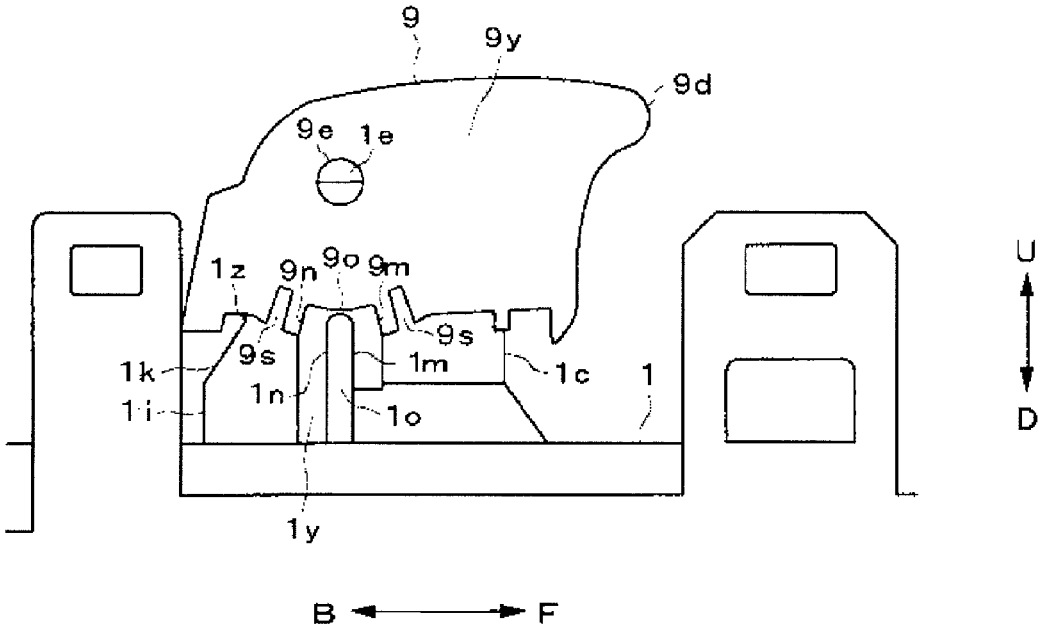
FIG. 9 illustrates a switch device according to still another embodiment of the present invention.

For example, as illustrated in FIG. 9, slits 9*s* may be provided in the front-back direction F and B of the notch 90 of the external surface 9*y* in the horizontal direction (direction perpendicular to the direction F and B and the direction U and D) of the manipulation knob 9, the elasticity may be imparted to not only the hit portions 1*m* and 1*n* but also to the hitting portions 9*m* and 9*n* on the side of the manipulation knob 9 to increase the amount of deformation generated by the hitting.

Figure 10:
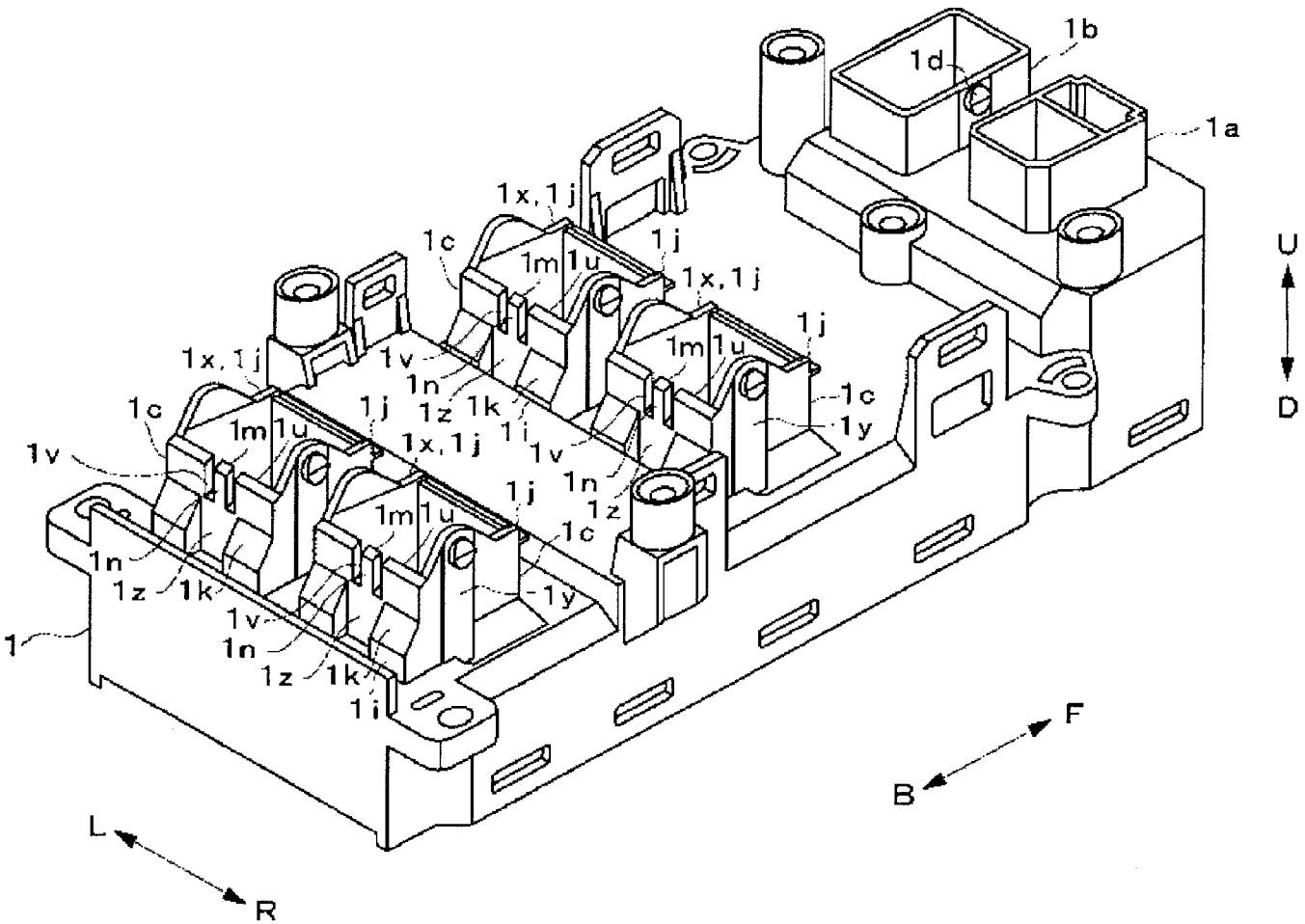
FIG. 10 is a perspective view illustrating a casing of a switch device according to a first modification of the present embodiment.
Figure 11:
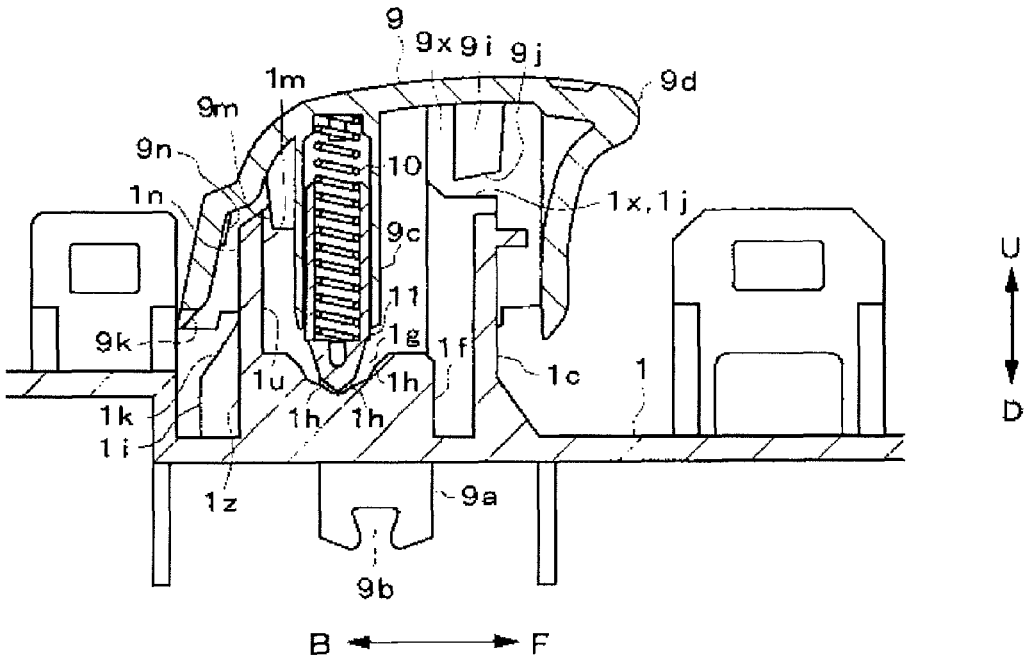
FIG. 11 is an enlarged sectional view illustrating a neighborhood of a manipulation knob of the switch device according to the first modification of the present embodiment.

In the embodiments above, the second hit portions 1*m* and 1*n* are provided in both side of the tubular portion 1*c*. Alternatively, as illustrated in a first modification of FIG. 10, the second hit portions 1*m* and 1*n* may be provided in the internal surface 1*u* at the back of the tubular portion 1*c* and the external surface 1*z* at the back of the tubular portion 1*c*. A pair of notches 1*v* is formed near the second hit portions 1*m* and 1*n* such that the second hit portions 1*m* and 1*n* are sandwiched therebetween. In this case, as illustrated in FIG. 11, the second hitting portions 9*m* and 9*n* are provided in the manipulation knob 9. Similarly the second hit portions 1*m* and 1*n* may be provided in the external surface in front of the tubular portion 1*c* and the internal surface in front of the tubular portion 1*c*, respectively.

Figure 12:
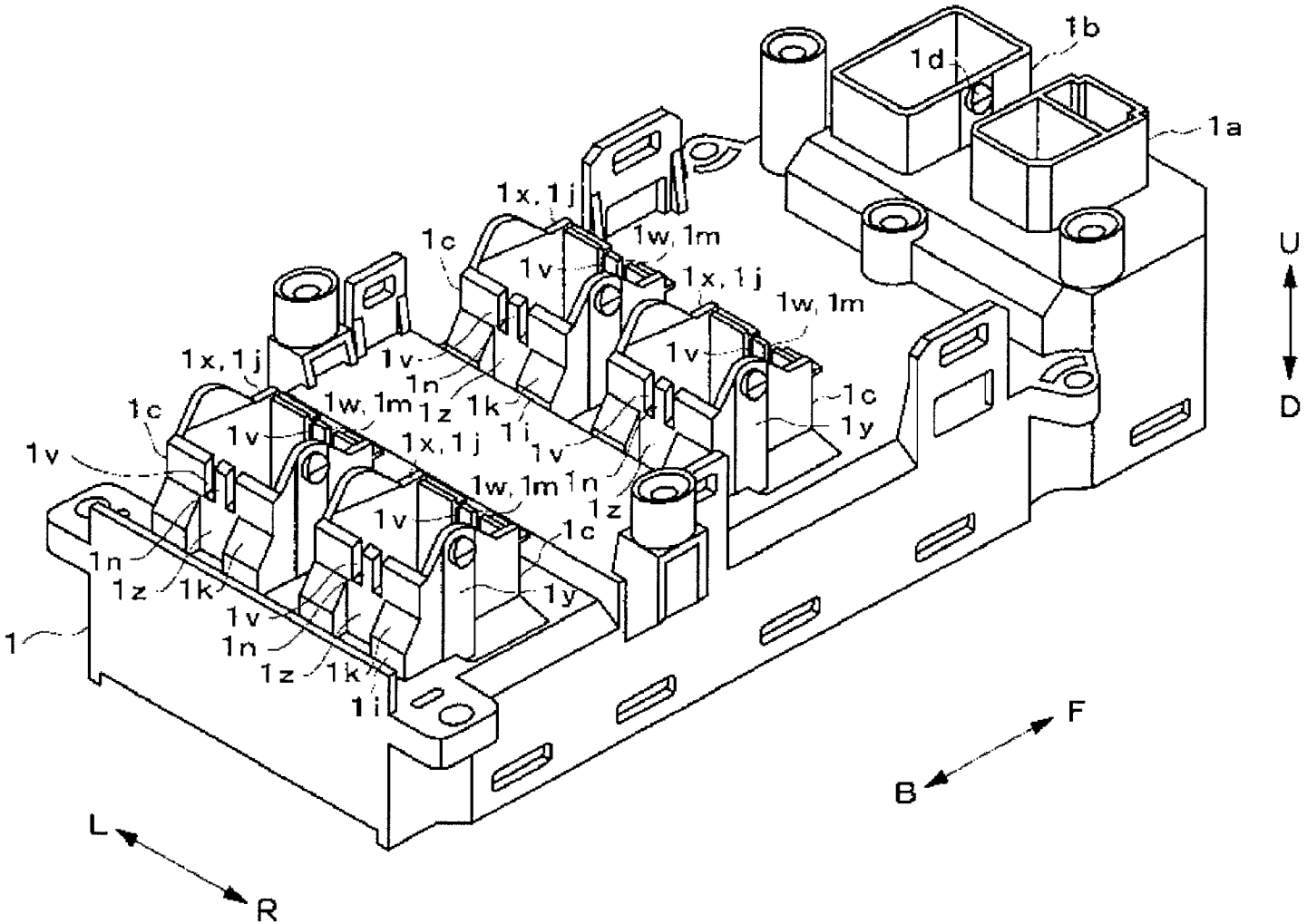
FIG. 12 is a perspective view illustrating a casing of a switch device according to a second modification of the present embodiment.
Figure 13:
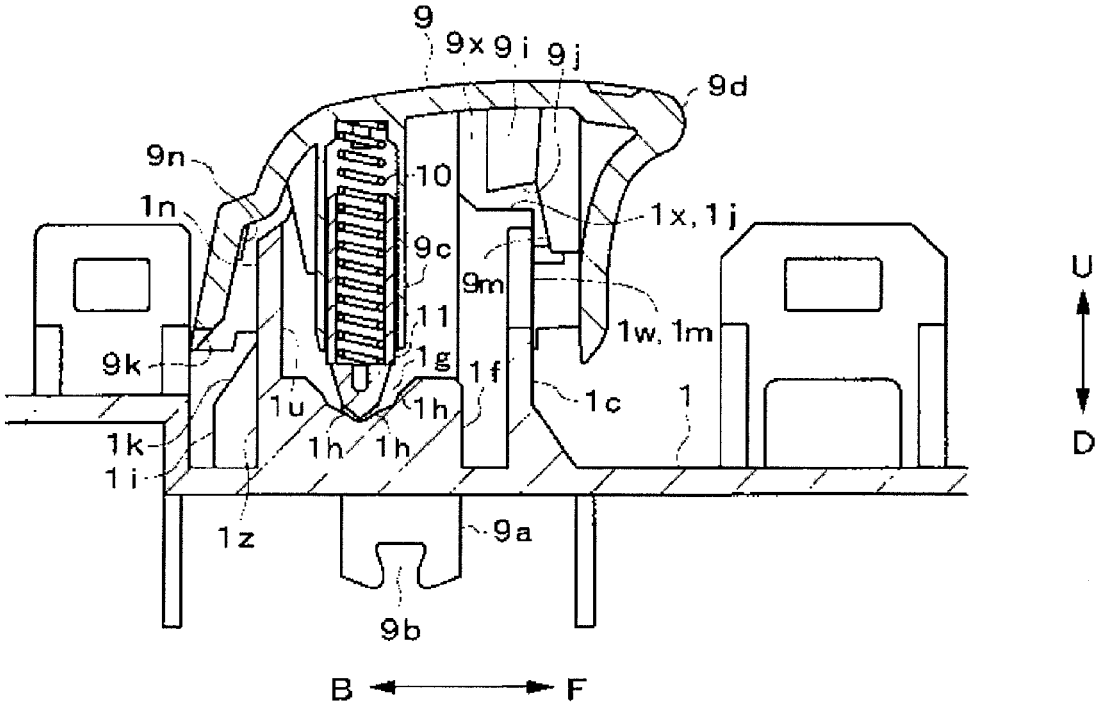
FIG. 13 is an enlarged sectional view illustrating a neighborhood of a manipulation knob of the switch device according to the second modification of the present embodiment.

As illustrated in a second modification of FIG. 12, the second hit portions 1*m* and 1*n* may be provided in an external surface 1*w* in front of the tubular portion 1*c* and the external surface 1*z* at the back of the tubular portion 1*c*, respectively. The pair of notches 1*v* is formed near the second hit portions 1*m* and 1*n* such that the second hit portions 1*m* and 1*n* are sandwiched therebetween. At this point, as illustrated in FIG. 13, the second hitting portions 9*m* and 9*n* are provided in the manipulation knob 9. Similarly the second hit portions 1*m* and 1*n* may be provided in the external surface at the back of the tubular portion 1*c* and the internal surface in front of the tubular portion 1*c*, respectively.

Although the electric switch 5 in which the actuator 5*a* is used is provided in the embodiments above, the present invention is not limited thereto, and the switch that switches the ON and OFF states may be provided. For example, there may be provided a switch in which rubber pressed according to the movement of the manipulation rod 9*a* is used.

In the embodiments above, an example is given of the case where one or more embodiments of the present invention is applied to a window opening and closing manipulation knob of the switch device used in a power window device and a member that supports the window opening and closing manipulation knob. However, one or more embodiments of the present invention can also be applied to a door locking manipulation knob and a member that supports the door locking manipulation knob. One or more embodiments of the present invention can also be applied to a manipulation knob of the switch device used in the door opening and closing device and a member that supports the manipulation knob. One or more embodiments of the present invention can also be applied to a manipulation knob of the switch device used in applications other than the vehicle and a member that supports the manipulation knob.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A switch device comprising:

a casing;

a tubular portion that is provided on the casing, an upper surface and a lower surface of the tubular portion being opened;

a support shaft that is provided in the tubular portion;

a manipulation knob that is attached to the tubular portion such that an opening in the upper surface is covered therewith, the manipulation knob being turned about the support shaft by manipulation;

a first hitting portion that is provided in the manipulation knob;

a first hit portion that is provided in the tubular portion, the first hitting portion hitting the first hit portion when the manipulation knob is turned to reach a limit of an operating range of a turning operation of the manipulation knob;

a second hitting portion that is provided in the manipulation knob independently of the first hitting portion; and a second hit portion that is provided in the casing so as to be separated from the tubular portion, the second hitting portion hitting the second hit portion when the manipulation knob is turned to reach the limit of the operating range of the turning operation of the manipulation knob, wherein ON and OFF states are switched based on the turning operation of the manipulation knob, the second hitting portion and the second hit portion are provided at positions at which the second hitting portion hits the second hit portion before the first hitting portion hits the first hit portion during the turning operation of the manipulation knob, at least one of the second hitting portion and the second hit portion bends when the second hitting portion hits the second hit portion, the second hit portion is formed on a projection, and a notch is formed between the tubular portion and the projection.

2. The switch device according to claim 1, wherein an area where the second hitting portion hits the second hit portion is smaller than an area where the first hitting portion hits the first hit portion.

3. The switch device according to claim 1, wherein the second hitting portion is provided in a lower-end portion of the manipulation knob, and the second hit portion is formed in a side portion of the tubular portion so as to be projected upward.

4. The switch device according to claim 1, further comprising:

a switch that is provided in the casing;

a manipulation rod that transmits the turning operation of the manipulation knob to switch the ON and OFF states of the switch; and an elastic material that generates an elastic force for returning the turned manipulation knob to a predetermined stationary position.

5. A switch device comprising:

a casing;

a tubular portion that is provided on the casing, an upper surface and a lower surface of the tubular portion being opened;

a support shaft that is provided in the tubular portion;

a manipulation knob that is attached to the tubular portion such that an opening in the upper surface is covered therewith, the manipulation knob being turned about the support shaft by manipulation;

a first hitting portion that is provided in the manipulation knob;

a first hit portion that is provided in the tubular portion, the first hitting portion hitting the first hit portion when the manipulation knob is turned to reach a limit of an operating range of a turning operation of the manipulation knob;

a second hitting portion that is provided in the manipulation knob independently of the first hitting portion; and a second hit portion that is provided in a surface identical to a surface in which the first hit portion of the tubular portion is provided, the second hitting portion hitting the second hit portion when the manipulation knob is turned to reach the limit of the operating range of the turning operation of the manipulation knob, wherein ON and OFF states are switched based on the turning operation of the manipulation knob, a notch is formed near the second hit portion in the surface identical to the surface in which the first hit portion is provided, the second hitting portion and the second hit portion are provided at positions at which the second hitting portion hits the second hit portion before the first hitting portion hits the first hit portion during the turning operation of the manipulation knob, and at least one of the second hitting portion and the second hit portion bends when the second hitting portion hits the second hit portion.

6. The switch device according to claim 2, wherein the second hitting portion is provided in a lower-end portion of the manipulation knob, and the second hit portion is formed in a side portion of the tubular portion so as to be projected upward.

7. The switch device according to claim 2, further comprising:

a switch that is provided in the casing;

a manipulation rod that transmits the turning operation of the manipulation knob to switch the ON and OFF states of the switch; and an elastic material that generates an elastic force for returning the turned manipulation knob to a predetermined stationary position.

8. The switch device according to claim 3, further comprising:

a switch that is provided in the casing;

a manipulation rod that transmits the turning operation of the manipulation knob to switch the ON and OFF states of the switch; and an elastic material that generates an elastic force for returning the turned manipulation knob to a predetermined stationary position.

9. The switch device according to claim 6, further comprising:

a switch that is provided in the casing;

a manipulation rod that transmits the turning operation of the manipulation knob to switch the ON and OFF states of the switch; and an elastic material that generates an elastic force for returning the turned manipulation knob to a predetermined stationary position.

* * * * *